US007447250B2

(12) United States Patent
Kawasaki et al.

(10) Patent No.: US 7,447,250 B2
(45) Date of Patent: Nov. 4, 2008

(54) ELECTROSTATIC SUSPENSION FURNACE AND METHOD FOR FUSING SAMPLES USING THIS

(75) Inventors: Kazunori Kawasaki, Tokyo (JP); Hiroaki Asahi, Tokyo (JP)

(73) Assignee: IHI Aerospace Co., Ltd, Tokyo (JP)

( * ) Notice: Subject to any disclaimer, the term of this patent is extended or adjusted under 35 U.S.C. 154(b) by 278 days.

(21) Appl. No.: 10/549,903

(22) PCT Filed: Feb. 25, 2004

(86) PCT No.: PCT/JP2004/002190

§ 371 (c)(1),
(2), (4) Date: Sep. 20, 2005

(87) PCT Pub. No.: WO2004/083757

PCT Pub. Date: Sep. 30, 2004

(65) Prior Publication Data

US 2006/0203417 A1 Sep. 14, 2006

(30) Foreign Application Priority Data

Mar. 20, 2003 (JP) ..... 2003-078762

(51) Int. Cl.
*H05B 11/00* (2006.01)

(52) U.S. Cl. ..... 373/2; 373/10; 361/144

(58) Field of Classification Search ..... 373/2, 373/10, 144, 60, 61–63; 219/121.86, 123, 219/124.1, 124.22, 124.33; 310/309, 311, 310/317, 366; 361/144, 126, 147; 148/672, 148/240, 421

See application file for complete search history.

(56) References Cited

U.S. PATENT DOCUMENTS 3,689,324 A * 9/1972 Weiner et al. ..... 148/672
7,061,964 B2 * 6/2006 Kawasaki et al. ..... 373/2

FOREIGN PATENT DOCUMENTS

JP 11-241888 A 9/1999
JP 2005-206865 A 7/2002

* cited by examiner

*Primary Examiner*—Quang T Van
(74) *Attorney, Agent, or Firm*—Sughrue Mion, PLLC

(57) ABSTRACT

An electrostatic levitation furnace wherein main electrodes opposed to each other within a vacuum chamber are arranged at intervals to form interspaces between them. Auxiliary electrodes are arranged to correspond to each of the electrostatic field generating interspaces, and laser irradiators are arranged above the uppermost main electrode and under the lowermost main electrode, and the main electrode positioned midway between the uppermost and lowest one has a through-hole on an optical path of laser beam which a sample can be passed through. When two species of samples are fused together, regardless of whether or not the samples are conductors, the furnace has the function of melting the levitated samples and fusing them together while maintaining each of the temperatures of the samples, and consequently this permits realization of fusion in a state free of external interference.

4 Claims, 5 Drawing Sheets

ELECTROSTATIC SUSPENSION FURNACE AND METHOD FOR FUSING SAMPLES USING THIS

This is a National Stage entry of International Application PCT/JP2004/002190, with an international filing date of Feb. 25, 2004, which was published as WO 2004/083757 A1, and the complete disclosure of which is incorporated into this application by reference.

TECHNICAL FIELD

The present invention relates to an electrostatic levitation furnace for putting a charged sample in a levitation state by electrostatic field generated between electrodes and performing heating process on the sample.

BACKGROUND ART

In a conventional art, an electrostatic levitation furnace where a pair of main electrodes is allocated in a flat and approximately cylindrical vacuum chamber on Z axis corresponding to an axis of the chamber, and also a pair of auxiliary electrodes is allocated on each of X axis and Y axis orthogonal to Z axis is well known.

The electrostatic levitation furnace charges a sample which is inputted between main electrodes by electrode contact, ultraviolet irradiation, or heating in advance, puts the sample in a levitation state by electrostatic field generated between main electrodes, and while maintaining the sample in a predetermined position by controlling a electric potential between main electrodes or between auxiliary electrodes, irradiates a laser beam on the sample to heat and melt the same. To cool and solidify the sample which is heated and melted in this way enables to generate crystals in a state excluded from external interference (i.e. in a state avoided the use of a container).

The conventional electrostatic levitation furnace mentioned above has the function of melting a sample maintained in a levitation state, but does not have the one of melting two or more species of samples while levitating because of incapable of putting a plurality of samples in a levitation state using one electrostatic field.

As an electrostatic levitation furnace except for the one mentioned above, an electromagnetic levitation furnace which levitates a sample electromagnetically is well known. For example, when two species of samples are fused together using the aforesaid electromagnetic levitation furnace, two species of samples are heated with superimposed, the sample melted in first due to difference of electrical resistances is adhered the one which is not melted yet, and then both of the samples are levitated as a unit and are melted as a whole to fuse together. On the grounds of above, there is a problem that such fusion does not regard as a fusion in a state excluded from external interference (i.e. in a state avoided the use of a container), and there is also a further problem that each of temperatures of two species of samples is not adjusted independently.

It comes near to stating the obvious that even if using an electromagnetic levitation furnace, it is extremely difficult to make nonconductors fuse due to nonconductor is levitated only in being melted. This is a subject to solve these problems.

DISCLOSURE OF THE INVENTION

The present invention has been made in view of the problems in such a conventional art and an object of the invention is to provide a electrostatic levitation furnace which, for example, when fusing two species of samples together, irrespective of whether or not the samples are conductors, makes the samples melt while levitating them individually and fuses the samples together while maintaining temperatures of the samples respectively, and consequently actualize a fusion in a state excluded external interference, and a method for fusing plural species of samples all together using the same.

The present invention is an electrostatic furnace which is provided with a vacuum chamber, main electrodes opposed each other within the vacuum chamber, an auxiliary electrode which displaces a sample levitated by a electrostatic field generated between the main electrodes to a predetermined position, and a laser irradiator which irradiates a laser beam on the sample displaced into the predetermined position to melt the sample, wherein a plurality of the main electrodes are arranged at proper intervals in a vertical direction to form electrostatic field generating interspaces between adjacent main electrodes respectively, the auxiliary electrodes are arranged to correspond to each of the electrostatic field generating interspaces, the laser irradiators are arranged above the uppermost main electrode and under the lowest main electrode respectively so as to be opposed to each other coaxially, and the main electrode positioned midway between the uppermost one and the lowest one has a through-hole on optical path of laser beam which a sample can be passed through.

In preferred embodiment of the present invention, the electrostatic levitation furnace includes a vacuum chamber, main electrodes opposed to each other within the vacuum chamber, an auxiliary electrode which displaces a sample levitated by a electrostatic field generated between the main electrodes to the predetermined position, and a laser irradiator which irradiates a laser beam on the sample displaced into the predetermined position to melt the sample, wherein a plurality of pairs of main electrodes forming electrostatic field generating interspaces are stacked vertically, and also auxiliary electrodes are arranged to correspond to each of electrostatic field generating interspaces, the laser irradiators are arranged above the uppermost main electrode and under the lowest main electrode respectively so as to be opposed to each other coaxially, the main electrode positioned midway between the uppermost one and the lowest one has a through-hole on optical path of laser beam which a sample can be passed through. For more preferred embodiment of the present invention, the electrostatic levitation furnace is provided with an image pickup device so as to extend to adjacent electrostatic field generating interspaces, which includes a complementary metal oxide semiconductor (CMOS) camera or a charge coupled device (CCD) camera photographing a sample, a background light source irradiating a light on the sample, and a digital signal processor which executes image processing for edge enhancement in real time and outputs a position of the center of gravity of the sample maintained in a levitation state.

On the other hand, a method for fusing plural species of samples all together using the electrostatic levitation furnace of the present invention comprises, in fusing plural species of samples all together using either one of the electrostatic levitation furnace mentioned above, a step for levitating a first sample on the optical path of a laser beam in either one of electrostatic field generating interspaces and then irradiating a laser beam on the first sample from a laser irradiator of either side of main electrodes to melt the sample, a step for, while levitating the first sample which is kept in a melted state to be irradiated a laser beam, levitating a second sample on the optical path of a laser beam in another one of the electrostatic filed generating interspaces and then irradiating a laser beam on the second sample from a laser irradiator of the other side of main electrodes to melt the second sample, a step for moving the sample from the upper one of the electrostatic field generating interspaces levitating each of the first and the second sample in a melted state through a through-hole in main electrode placed midway to an electrostatic field generating interspace placed lower and then fusing the melted samples together in keeping a levitation state, a step for stopping both of the irradiation of laser beam from the upper and the lower laser irradiators to solidify an fused body from the first and the second samples and then moving the fused body at a predetermined position within an electrostatic field generating interspace placed lower, and wherein plural species of samples are fused all together through the aforementioned steps.

The electrostatic levitation furnace of the invention has plural electrostatic field generating interspaces and auxiliary electrodes corresponded to each of the electrostatic field generating interspaces. This enables to levitate and move plural species of samples in each of the electrostatic field generating interspaces. To irradiate a laser beam on each of the samples levitated in electrostatic field generating interspaces from each of laser irradiators at the side of main electrodes placed uppermost and lowest respectively enables to melt the samples levitated individually and keep the temperature of the samples. In the above-mentioned situation, the sample positioned upper is moved down, with controlling a temperature and a fall velocity of the sample, from the upper electrostatic field generating interspace through a through-hole of the mid main electrode to the lower electrostatic field generating interspace, and then the samples in melted states are fused together in holding levitated.

Since plural species of samples are levitated in each electrostatic field generating interspace individually until being fused together, for example, disposing an image pickup device so as to extend to two adjacent electrostatic field generating interspaces due to obtain the position information of a sample, one image pickup device can capture a sample in one electrostatic field generating interspace and a sample in another one individually and accordingly there is no need to dispose the image pickup devices as many as electrostatic field generating interspaces. This enables to downsize the electrostatic levitation furnace.

In more preferred embodiment of the present invention, an electrostatic levitation furnace has the function of capturing plural species of samples individually using a CMOS camera or a CCD camera as a image pickup device provided to extend to adjacent electrostatic field generating interspaces and sampling position information of the samples at high velocities of about 1 kHz by executing image processing of digital signal processor.

A method for fusing samples together using the electrostatic levitation furnace of the invention is adopted the above constitution, which enables to melt plural species of samples while levitating them individually and to fuse them all together while keeping the temperature of each sample.

BRIEF DESCRIPTION OF THE INVENTION

BEST MODE FOR CARRYING OUT THE INVENTION

Figure 1:
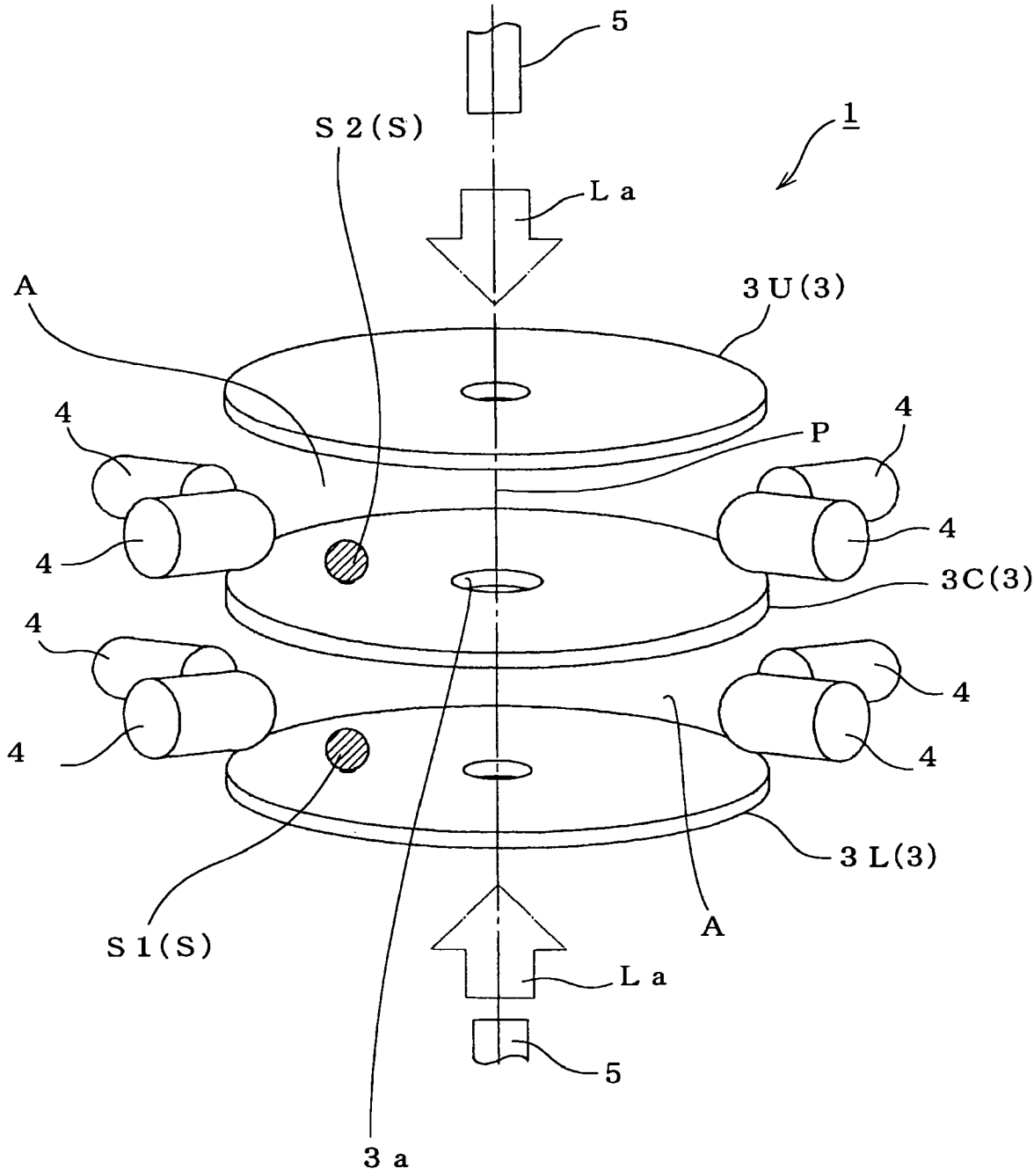
FIG. 1 is an explanatory diagram of arrangement of main electrodes and auxiliary electrodes showing one embodiment of an electrostatic levitation furnace of the present invention.
Figure 2:
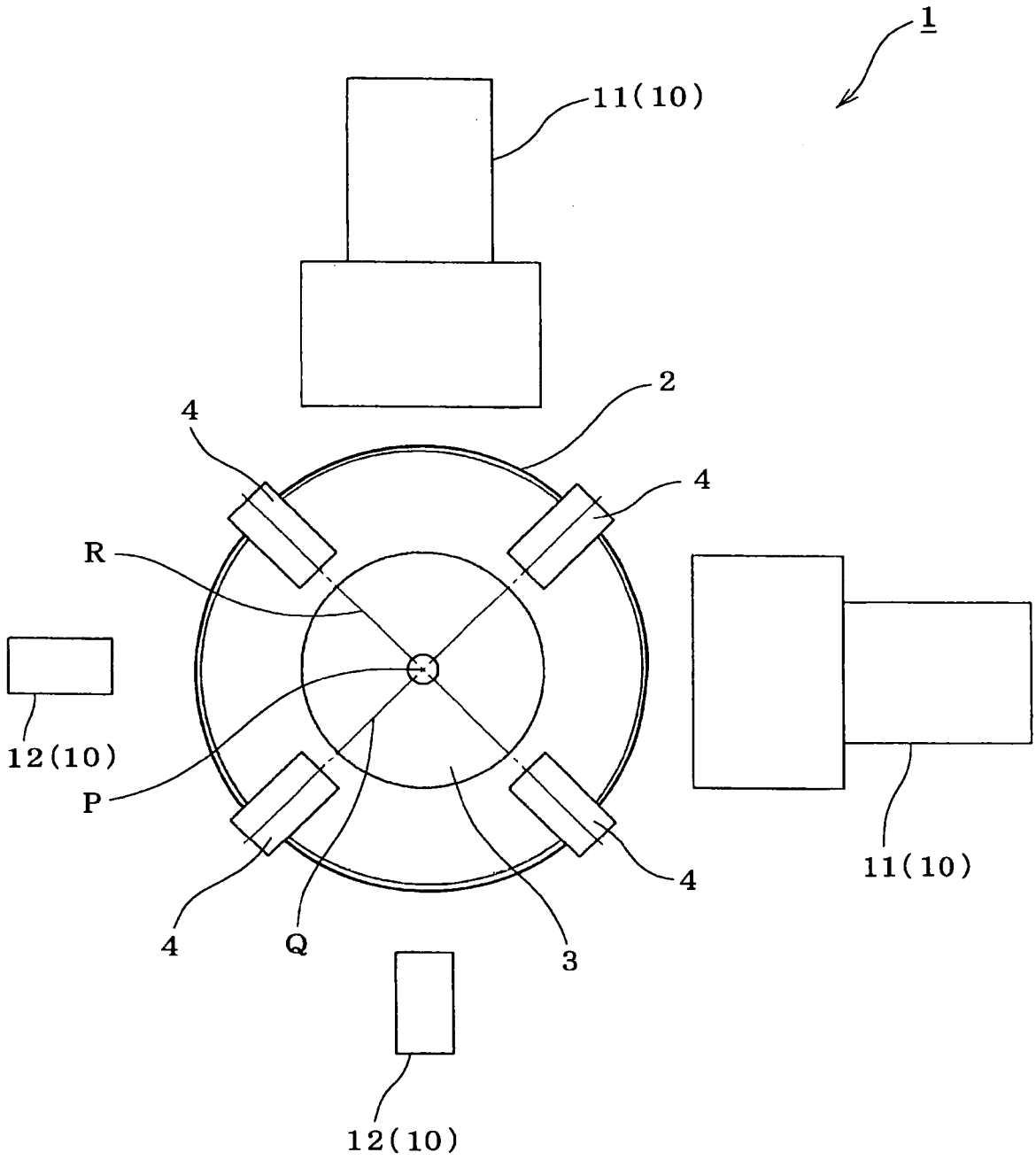
FIG. 2 is a cross-sectional explanatory diagram of the electrostatic levitation furnace showing FIG. 1.

The present invention will be explained below with referring to the accompanying drawings. It is to be understood that a detailed constitution of an electrostatic levitation furnace of the invention is not limited to the only following embodiments.

FIGS. 1 to 4 show one embodiment of an electrostatic levitation furnace of the present invention. As shown FIGS. 1 to 3, the electrostatic levitation furnace 1 is provided with a vacuum chamber 2 (shown in FIG. 2 only), plural (three, in this embodiment) sheets of disc-form main electrodes 3 provided at intervals of 5 to 10 mm in a vertical direction within the vacuum camber 2, where an interspace between the adjacent main electrodes 3 and 3 is defined as an electrostatic filed generating interspace A.

The electrostatic levitation furnace 1 is provided with an auxiliary electrode 4 displacing a levitated sample S to a predetermined position (on P axis passing through the centers of main electrode 3) by electrostatic field generated in an electrostatic filed generating interspace A between main electrodes 3 and 3, and a laser irradiator 5 irradiating a laser beam La on a sample S displaced the predetermined position to melt the sample.

The auxiliary electrodes 4 are arranged in pairs each of on Q axis and on R axis which cross each other at right angles on a plane orthogonal to the arranging direction of main electrodes 3, i.e. on a plane orthogonal to P axis. The laser irradiators 5 are arranged both of the upper side 3U of a uppermost main electrode (i.e. one main electrode) and the lower side 3L of a lowest main electrode (i.e. the other main electrode) so as to be opposite to each other on P axis.

In this case, the uppermost main electrode 3U and the lowest main electrode 3L are connected with high-speed and high-voltage amplifiers 6 respectively, and the mid main electrode 3C between the uppermost one and the lowest one has a through-hole 3*a* which a sample S can be passed through at the center which P axis passes through, i.e. at the center which corresponds to on an optical path of laser beam La.

The electrostatic levitation furnace 1 is provided with an image pickup device 10 disposed to extend to two electrostatic field generating interspaces A and A. The image pickup device 10 includes a CCD camera 11 (or a CMOS camera) which photographs samples S and S levitated independently in electrostatic field generating interspaces A and A, a metal halide light source 12 which is placed on the opposite side of a sample S from a CCD camera 11 and irradiates a light in a wavelength of 400 to 450 nm on a sample S to act as a background light source, and a digital signal processor (not shown) which executes image processing enhancing the edge of an image captured by a CCD camera 11 in real time and outputs a position of the center of gravity of a levitated sample S. Two sets of image pickup devices 10 are arranged to be orthogonal to each other.

Figure 3:
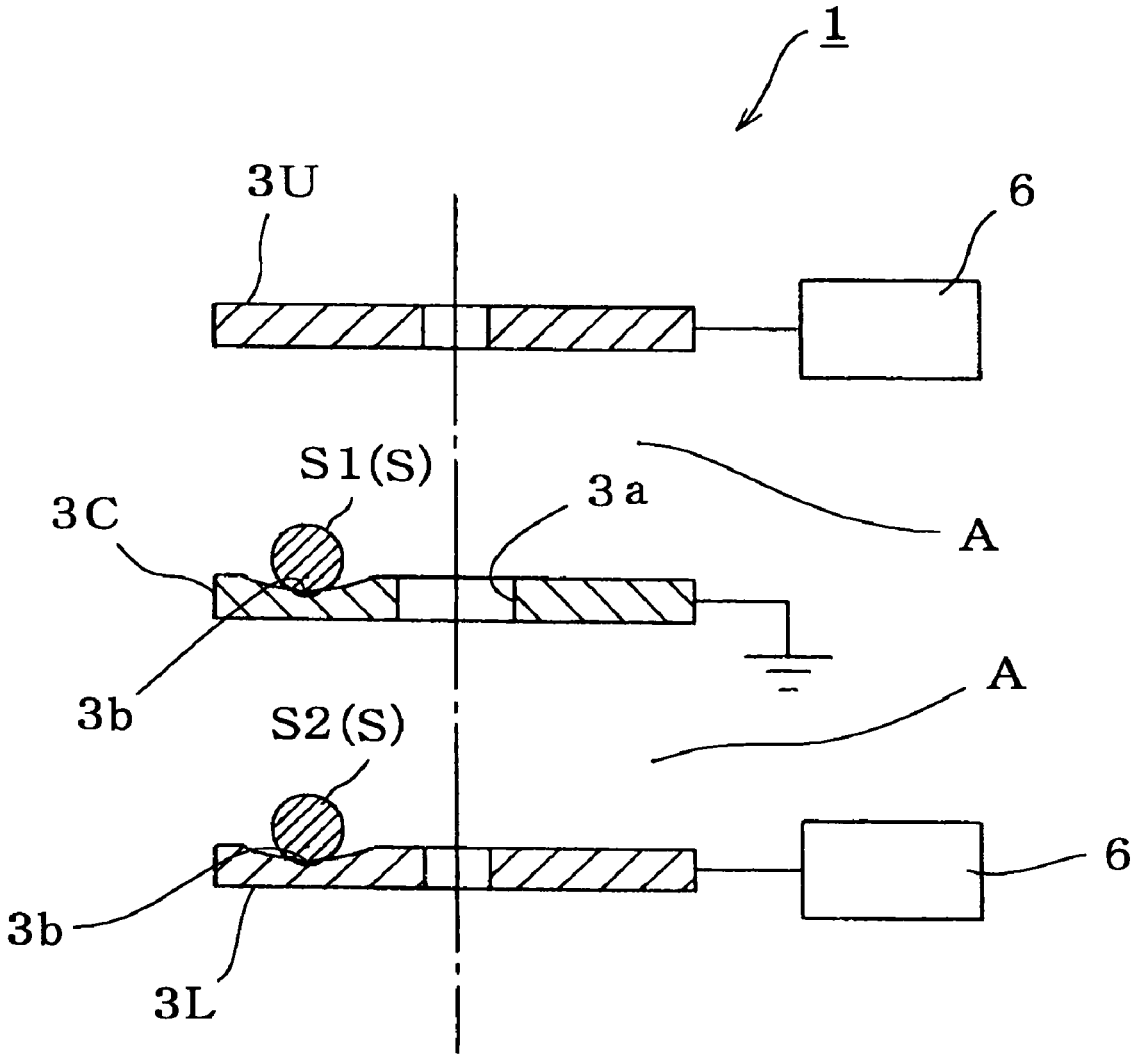
FIG. 3 is a schematic vertical sectional view of the electrostatic levitation furnace showing FIG. 1.

A reference number of 3*b* in FIG. 1 and FIG. 3 denotes a sample placing spot.

Next, a procedure for fusing samples together using the electrostatic levitation furnace 1 with above constitution will be illustrated.

Figure 4A:
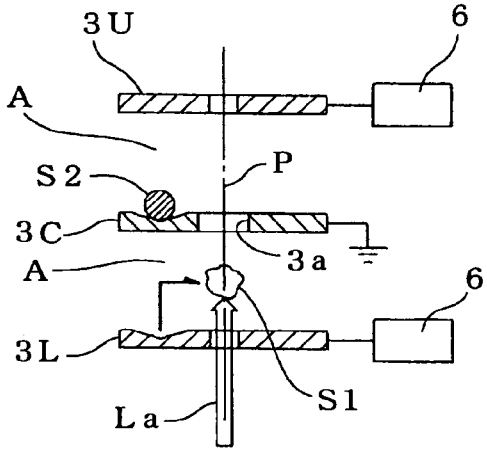
FIGS. 4A to 4D are an process explanatory diagrams of steps for fusing two species of samples together using the electrostatic levitation furnace showing FIG. 1.

In a first step shown FIG. 4A, after a first sample S1 (S) which is inputted into a electrostatic field generating interface A positioned at lower in two is charged, while a sample S1 is put a levitation state by a electrostatic field generated in a electrostatic field generating interspace A between main electrodes 3C and 3L, the sample S1 is displaced and maintained at a predetermined position P by controlling electric potential of difference between main electrodes 3C and 3L and between auxiliary electrode 4 and 4, and then, in this state, the first sample S1 is irradiated with a laser beam La from the lower laser irradiator 5 to melt the same.

Figure 4B:
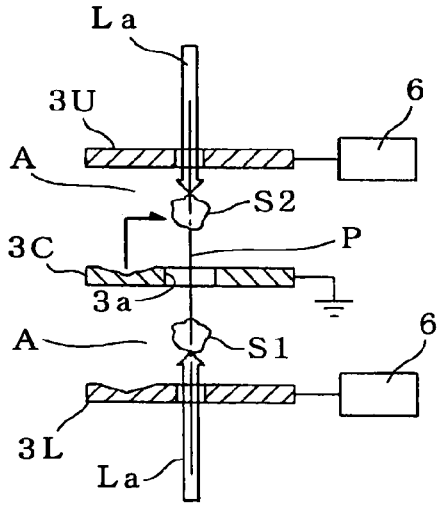

In a second step shown FIG. 4B, while the first sample S1 which is maintained in a melted state by irradiating a laser beam La on the sample is being levitated at the predetermined position P, a second sample S2 (S) which is inputted into the upper electrostatic field generating interspace A is charged. Subsequently the second sample S2 is put in a levitation state by electrostatic field generated the electrostatic field generating interspace A between main electrodes 3C and 3U, the sample S2 is displaced and maintained at the predetermined position P by controlling electric potential of difference between main electrodes 3C and 3U and between auxiliary electrodes 4 and 4, and the second sample S2 is irradiated with a laser beam La from the upper laser irradiator 5 to be melted.

Figure 4C:
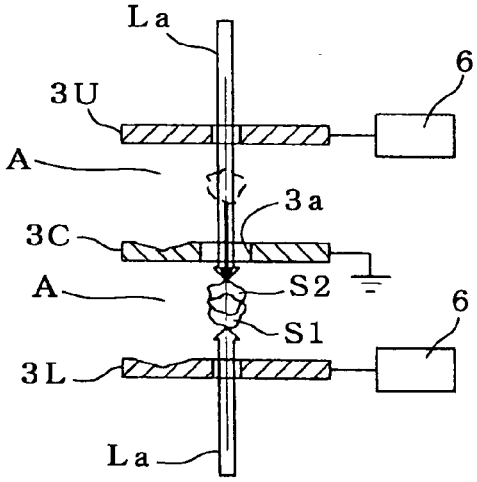
Figure 4D:
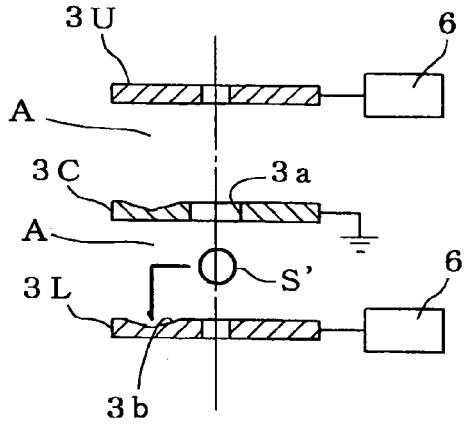

In a third step shown FIG. 4C, the second sample S2 is moved from the upper electrostatic field generating interspace A levitating the sample S2 through the through-hole 3*a* of the mid main electrode 3C to the lower electrostatic field generating interspace A while controlling the temperature, position, and fall velocity of the sample S2, and the samples S1 and S2 in melted states are fused together in retaining in levitation states.

In a fourth step, stopping both irradiation of laser beam La from the upper and the lower laser irradiators 5 and 5, a fused body S' from the first sample S1 and the second sample S2 is solidified and the sample S1 is moved at a sample placing spot 3*b* in the lower electrostatic field generating interspace A by controlling electric potential of difference between main electrodes 3C and 3L and between auxiliary electrodes 4 and 4.

In the above mentioned steps, through capturing the samples S1 and S2 individually by each of CCD cameras 11 on two sets of image pickup devices 10 orthogonal to each other disposed to extended to two electrostatic field generating interspace A and A and sampling each of position information of the samples S1 and S2 at high velocities of about 1 kHz by executing image processing in digital signal processor, the position of the samples S1 and S2 are always recognized.

As mentioned above, the electrostatic levitation furnace 1 of the embodiment and the method for fusing samples together using the same have the function of melting samples S1 and S2 kept levitated individually regardless of whether or not the samples S are conductor and fusing the samples S1 and S2 together while maintaining each temperature of the samples, and therefore achieve a fusion of the samples S1 and S2 in a state avoided the use of a container.

In the electrostatic levitation furnace 1, since the samples S1 and S2 are levitated in each electrostatic field generating interspace A and A individually, the first sample S1 and the second sample S2 can be captured individually by two sets of image pickup devices 10 and 10 disposed to extend to electrostatic field generating interspaces A and A orthogonal to each other, the entire electrostatic levitation furnace is downsized by reduction the number of the image pickup devices, and it becomes possible that each of the position information of the samples S1 and S2 levitated in two electrostatic field generating interspaces A respectively is sampled at high velocities.

The above-mentioned embodiment shows the case that the first sample S1 inputted into the lower electrostatic field generating interspace A of two is melted and subsequently the sample S2 inputted into the upper electrostatic field generating interspace A is melted, however, it is possible that a second sample S2 inputted into the upper electrostatic field generating interspace A is melted first or both of samples S1 and S2 are melted simultaneously.

Figure 5:
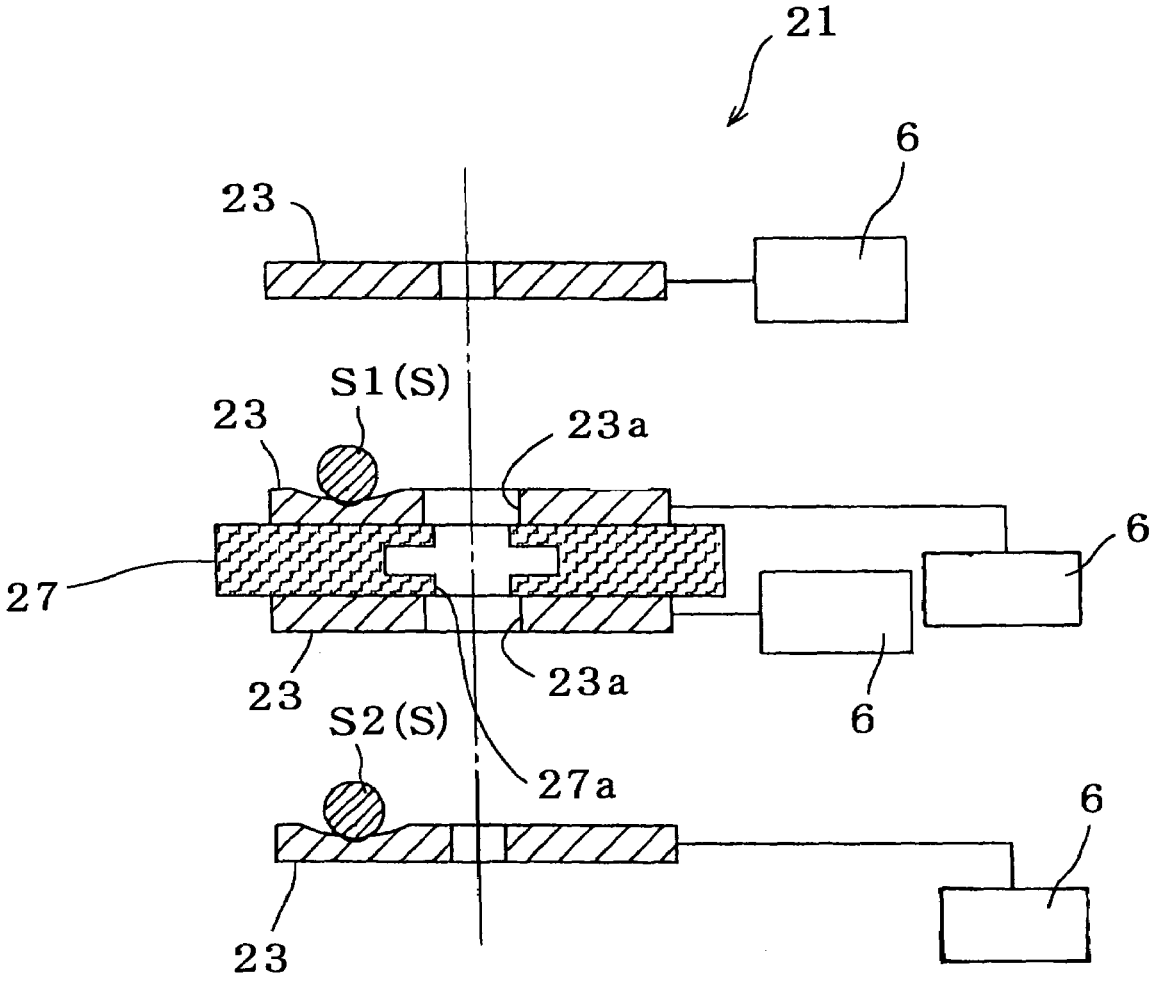
FIG. 5 is a schematic vertical sectional view of showing another embodiment of an electrostatic levitation furnace of the present invention.

FIG. 5 shows another embodiment of an electrostatic levitation furnace of the invention. An electrostatic levitation furnace 21 of this embodiment is different from the electrostatic levitation furnace 1 of the preceding embodiment in that two pairs of main electrodes 23 and 23, each pair forms an electrostatic field generating interspace A, are laminated with sandwiching insulating layer 27 in vertical direction, a high-speed and high-voltage amplifier 6 is connected to the main electrodes 23, and a through-hole 27*a* of the approximately equal size of the through-hole 23*a* provided in the mid main electrode 23 is provided in an insulating layer 27. Other constitution of the electrostatic levitation furnace of this embodiment is equal to the preceding one.

The electrostatic levitation furnace 21 also has the function of, regardless of whether or not the samples S are conductors, melting the samples S1 and S2 being levitated individually and fusing the samples S1 and S2 together while maintaining the temperature of the samples respectively, and therefore it becomes possible to fuse the samples S1 and S2 together in a state avoided the use of container. Since the high-speed and high-voltage amplifiers 6 are connected to the main electrodes 23 respectively, it is possible to generate an electrostatic field with high voltage potential without using an amplifier with high peak voltage (for example, an amplifier with a peak voltage of 20 kV), i.e. it is possible to generate an electrostatic field with high voltage potential using an amplifier with low peak voltage (for example, am amplifier with a peak voltage of 10 kV) which allows simplification of a system.

Both of the above-mentioned embodiments show the case that two electrostatic field generating interspaces A are formed and two samples S1 and S2 are fused together, but the present invention is not limited to such case. It is possible to form a large number of electrostatic field generating interspaces A by arranging a large number of main electrodes 3 and 23 and to fuse sequentially many species of samples S corresponding amounts of these electrostatic field generating interspaces A.

INDUSTRIAL APPLICABILITY

As explained above, according to the electrostatic levitation furnace of the present invention and the method for fusing plural species of samples all together using the same, for example, when two species of samples are fused together, regardless of whether or not the samples are conductors, it is possible to melt the samples being levitated individually and to fuse the samples together while maintaining each temperature of the samples, and a quite excellent advantage can be obtained that a fusion in a state excluded external interference, i.e. in a state avoided the use of a container is actualized.

For example, only by installing an image pickup device for obtaining position information of a sample to extend to two adjacent electrostatic field generating interspaces, a sample in one electrostatic field generating interspace and a sample in the other one can be captured individually, and therefore a quite excellent advantage is obtained that a downsizing of an electrostatic levitation furnace can be actualized because it is unnecessary to install image pickup devices corresponding amounts of electrostatic field generating interspaces.

In more preferred embodiment of the invention, a quite excellent advantage is obtained that a downsizing of an entire electrostatic levitation furnace is actualized and in addition each of position information of samples levitated in a plurality of electrostatic field generating interspaces respectively can be sampled at high velocities.

What is claimed is:

1. An electrostatic levitation furnace comprising a vacuum chamber, main electrodes opposed to each other within the vacuum chamber, auxiliary electrodes which move a sample levitated due to an electrostatic field generated between the main electrodes to a predetermined position, and laser irradiators which irradiate a laser beam on the sample displaced to the predetermined position to melt the sample, wherein a plurality of the main electrodes are arranged at proper intervals in a vertical direction to form electrostatic field generating interspaces between the adjacent main electrodes respectively, the auxiliary electrodes are arranged to correspond to each of the electrostatic field generating interspaces, the laser irradiators are arranged both above an uppermost one of said main electrodes and under a lowermost one of said main electrodes to be opposed to each other coaxially, and one of said main electrodes positioned midway between the uppermost one and the lowest one has a through-hole which is on an optical path of laser beam and through which a sample can be passed.

2. An electrostatic levitation furnace comprising a vacuum chamber, main electrodes opposed to each other within the vacuum chamber, auxiliary electrodes which move a sample levitated due to electrostatic field generated between the main electrodes to a predetermined position, and laser irradiators which irradiate the sample displaced the predetermined position to melt the sample, wherein plural pairs of the main electrodes forming electrostatic field generating interspaces are arranged stacked in a vertical direction, the auxiliary electrodes are arranged to correspond to each of the electrostatic field generating interspaces, the laser irradiators are arranged both above an uppermost one of said main electrodes under a lowermost one of said electrodes, and one of said main electrode positioned midway between the uppermost lowest one has a through-hole on an optical path of laser beam which a sample can be passed through.

3. An electrostatic levitation furnace according to claim 1 wherein an image pickup device comprising a CMOS camera or a CCD camera photographing a sample, a background light source irradiating a light on a sample, and a digital signal processor executing image processing which enhances the edge of an image in real time and outputting a position of the center of gravity of a sample put in a levitation state is provided so as to extend to adjacent electrostatic field generating interspaces.

4. A method for fusing samples together using an electrostatic levitation furnace, comprising, in fusing a plurality of species of samples all together using an electrostatic levitation furnace according to claim 1;

a step for levitating a first sample on an optical path of a laser beam in either of plural electrostatic field generating interspaces and subsequently irradiating the laser beam on the first sample from a laser irradiator at the side of one main electrode to melt the sample;

a step for, while levitating a first sample maintained in a melted state by irradiating a laser beam on the first sample, levitating a second sample on an optical path of a laser beam in another of said electrostatic field generating interspaces and subsequently irradiating a laser beam on the second sample from another laser irradiator at the side of the other main electrode to melt the sample;

a step for moving the sample positioned in an upper one of the electrostatic field generating interspaces which levitate the first and the second samples in melted states respectively from said upper one electrostatic field generating interspace through a through-hole of a main electrode positioned midway to said lower one electrostatic field generating interspace while controlling the temperature, position, and fall velocity of the sample, and subsequently fusing the samples in melted states together while levitating them;

a step for stopping irradiation of laser beams from both the upper and the lower laser irradiators to solidify a fused body from the first and the second samples, and subsequently moving the fused body at a predetermined position in the lower electrostatic field generating interspace, wherein a plurality of species of samples are fused all together through the above-mentioned steps.

* * * * *